United States Patent [19]

Malik

[11] 3,991,970

[45] Nov. 16, 1976

[54] RETAINER CLIP FOR SECURING A HOT TOP

[76] Inventor: James J. Malik, 6618 Bennington Drive, Parma Heights, Ohio 44130

[22] Filed: May 12, 1975

[21] Appl. No.: 576,345

[52] U.S. Cl. ..... 249/106; 249/202
[51] Int. Cl.[2] ..... B22D 7/10
[58] Field of Search ..... 249/106, 197–202

[56] References Cited

UNITED STATES PATENTS 3,362,677 1/1968 Folberth ..... 249/202

*Primary Examiner*—Robert D. Baldwin
*Attorney, Agent, or Firm*—Alfred D. Lobo

[57] ABSTRACT

A retainer clip is formed from elongated rod or wire as a continuous L-shaped member having a pair of arms substantially at right angles to one another. Each arm has a resilient loop formed by bending the end portion of the arm through at least one complete turn. Each arm of the L-shaped member extends along of two sideboards in end-adjacent relationship with each other, biasing flatly against end-adjacent inner walls of the ingot mold. The end portion of each arm abuts the next adjacent sideboard orthogonally, the arm biasing parallel oppositely disposed sideboards against inner walls of the ingot mold. Each retainer clip thus thrusts one pair of sideboards, in end-adjacent relationship with each other, against coextensive inner walls of the ingot mold, and at the same time, thrusts against portions of two diagonally oppositely disposed sideboards also in end-adjacent relationship with each other. The arms of each retainer clip and the resilient loop in the end-portion of each arm are formed in essentially the same plane. At least one pair of retainer clips is used to retain four sideboards of a conventional hot top of an ingot mold, one retainer clip diagonally oppositely disposed to the other so that the arms of each of the retainer clips bias at least some portion of all the sideboards against the inner walls of the ingot mold in close fitting engagement therewith.

5 Claims, 12 Drawing Figures

RETAINER CLIP FOR SECURING A HOT TOP

BACKGROUND OF THE INVENTION

It is common practice to cast molten metals, particularly ferrous metals such as steel, to form large ingots, and to line the upper portion or head of the ingot mold with slabs or sideboards of a heat-insulating or exothermic material. These slabs or sideboards are often both insulating and exothermic, and serve to delay the loss of heat from the molten metal, thus maintaining its molten state long enough to compensate for shrinkage in the body of the ingot as it solidifies. An assembly of such sideboards in an ingot mold is known as a "hot top." A hot top prevents undesirable voids and shrinkage in the ingot.

Preferred sideboards are heat-insulating sideboards conveniently formed of a low conductivity inorganic fiber or fibrous material, generally asbestos, alumina, glass wool or the like, which may be coated with a well-known exothermic material. As the molten metal contacts the exothermic material sideboard, a large quantity of heat is released. The insulating ability of the sideboard serves to retard dissipation of the heat and the hot top zone.

Conventionally, molds for ingots are more or less rectangular in horizontal section near the top, and are tapered from a large wide base to a relatively small top. Each of the four sides of the generally rectangular downwardly outwardly flaring hot top walls, is provided with a laminar slab or sideboard which is to be securely biased or otherwise held against each side. Conventionally, four sideboards are used which essentially completely cover the inner surfaces of the walls near the top of an ingot mold. The sideboards are inserted manually into the top of an ingot mold and must be secured snugly against the inner walls of the mold before the molten metal is poured into it. The importance of maintaining the sideboards flush against the inner surface of the ingot mold cannot be overstressed since molten metal flowing between the sideboards and the walls of the ingot mold will often ruin an ingot. Again, if the sideboard is not tightly biased against a wall of the ingot mold, it may float to the top and the function of the sideboard is frustrated.

To combat this problem, much effort has been devoted both to the design of the inner liner, including individual sideboards to form an inner liner, and to the means utilized for tightly securing the inner liner against the upper portion of the inner walls of the ingot wall. Over the years, a vast array of devices has been used, or suggested for use, with generally rectangular sideboards, for the sole purpose of providing an effective hot top for an ingot mold. Most of the devices have been discarded sooner or later, either because they are less effective than they should be, or they cost too much, or they are relatively inconvenient and unsafe to install.

It must be kept in mind that each of the aforementioned factors are of the utmost importance. It is unnecessary to reiterate that any means which is not reasonably safe and reliably effective will not be looked upon favorably by a foundry using it. Again, since hot tops are generally limited to usage only by large volume users, such as steel makers, it is of utmost importance the cost be such that the foundry of the steel maker can afford the expenditure. Of course, the retaining means used to secure the sideboards in an ingot mold are not reusable because it melts when molten metal submerges the retaining means.

As has been stated hereinabove, the retaining means for an inner liner is usually installed manually. Typically, a single person sets the liner into the top of the ingot mold, usually while the mold is still uncomfortably hot, and thereafter inserts some type of metal retaining means which he must then set into position by an additional manual operation. Popular means for securing a hot top in an ingot mold are exemplified by the clips disclosed in U.S. Pat. Nos. 3,734,454 and 3,762,033. In each of these devices, it will be noted that over-pieces of wire-ties are provided which must be twisted with a turn-key to secure the hot top. The over-pieces and wire-ties are welded to members which bias the sideboards against the inner walls of the ingot mold.

In still another device disclosed in U.S. Pat. No. 3,362,677, there is described a unitary frame provided with a spring clip at each corner which biases only two sideboards in end-adjacent relationship with each other. Each spring clip has a resilient loop at its vertex, and the arms are provided with small eyes at their ends to enable the spring clips to be deformed inwardly by tie-downs prior to insertion of the frame into a hot top assembly. The ends of the arms of each of the spring clips are freed by cutting the tie-downs so as to provide a biasing force against the sideboards of the inner liner. However, the cost of the frame, the difficulty of fabricating it, the difficulty of installing it, and the problem of effectively biasing the sideboards with the minimal tangential contact provided by the eyes on the ends of the arms of the spring clips, all militate against the popularity of this device.

The hot top assembly of my invention is unfettered by any of the problems of the prior art devices none of which includes two diagonally oppositely disposed L-shaped retainer clips, each of which simultaneously biases all four sideboards due to a resilient loop formed in or near the U-shaped spring end of each arm. Moreover, two sideboards in end-adjacent relationship are biased against the inner walls coextensive therewith by arms of an L-shaped member or retainer clip. The term "retainer clip" rather than "retainer" is used to identify each L-shaped member because a single L-shaped member does not effectively retain all four sideboards. Each retainer clip acts independently of the other, and requires no connecting means therebetween to provide an effective retainer for a hot top. Each arm of a retainer clip overlies a sideboard and extends over a major portion of the length of the sideboard. Furthermore, my retainer clips are particularly desirable because they are easily and relatively inexpensively fabricated, only two being required diagonally oppositely disposed, one from the other. Moreover the retainer clips are easy to handle prior to installation and easy to store.

SUMMARY OF THE INVENTION

It is therefore a general object of this invention to provide a retainer clip of rod or wire for securely holding an inner liner of a hot top against the inner surfaces of the ingot mold near the top thereof.

It is another general object to provide a wire retainer clip for a hot top, which clip is inexpensively formed from a single continuous piece of heavy wire, elongated rod or tubing which is sufficiently resilient so as to provide the requisite biasing force to tightly secure an inner liner against the upper inner surfaces of an ingot mold.

It is still another general object of this invention to provide an L-shaped wire retainer clip having at least one resilient loop near the end of each of two arms which extend along substantially the entire length of two sideboards in end-adjacent relationship, so that the end portion of each arm abuts one of the other sideboards.

It is a specific object of this invention to provide an L-shaped wire retainer clip having a pair of arms each of which terminates in a U-shaped end-portion having a resilient loop in the trough of the U-shaped portion.

It is another specific object of this invention to provide a wire retainer clip which is a continuous L-shaped spring holder with spring ends which simultaneously bias four separate sideboards such as are conventionally used in a hot top, utilizing a resilient, U-shaped end portion on each arm in which end portion a resilient loop is provided at the trough.

It is yet another specific object of this invention to provide a wire retainer clip which is rugged, easy to store, and which may be casually positioned with little or no skill by a person of average strength in so short a time as to substantially alleviate the discomfort of securing a hot top in an ingot mold.

It is still another specific object of this invention to enable a hot top to be securely positioned in a generally rectangular mold utilizing two oppositely disposed wire retainer clips which act independently of each other.

These and other objects and advantages of this invention will become apparent to those skilled in the art from the following description of preferred forms thereof, and the illustrations set forth herein.

Figure 1:
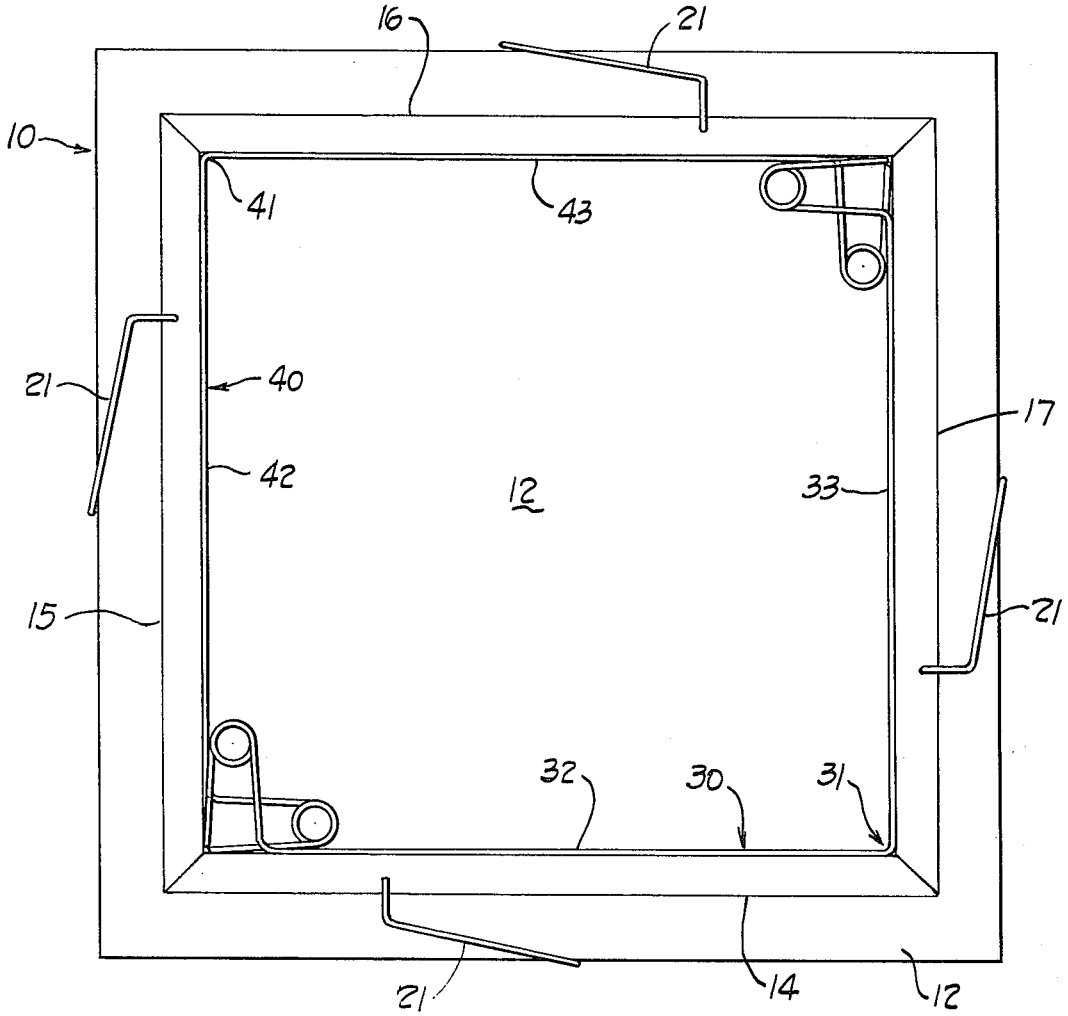
FIG. 1 is a plan view of a hot top assembly with four sideboards secured in an ingot mold by a pair of diagonally oppositely disposed wire retainer clips.

In the figures of the drawings, like reference numerals are used to denote like parts. Some illustrations of the parts and their relative positions have been dimensionally exaggerated for clarity of illustration and to facilitate the description of the operation of the retainer clips in a hot top assembly.

DETAILED DESCRIPTION OF PREFERRED EMBODIMENTS OF THE INVENTION

Referring now to FIG. 1 of the drawings, there is shown the top portion or mouth of an ingot mold 10 in which is positioned a hot top indicated generally at 12. The side walls of the ingot mold 10 are conventionally inclined slightly to facilitate removal of the solidified ingot. Hot top 12 is comprised of a plurality of preformed sideboards 14, 15, 16 and 17 positioned closely adjacent the inner wall surfaces of the mold 10 and coextensive therewith, each of two sideboards being in end adjacent relationship with one and another about the inner periphery of the mold. Conventionally sideboards in a hot top are as nearly continuous about the inner periphery as is practicable. Each sideboard is initially positioned within the mold by suspending means such as hanger straps 21, the top edges of the sideboards being flush with or slightly below the corresponding upper edges of the mold 10. Each sideboard is generally laminar and flat and is preformed to a size determined by the ingot mold in which it is to be used. Preferred materials for the sideboards include inorganic fibers impregnated with insulating materials such as diatomaceous earth and suitable organic and inorganic binders as is well-known in the art.

A pair of sideboards 14 and 15 are in end-adjacent relationship with each other, as are sideboards 15–16, 16–17 and 17–14. To clarify the identification of the four sideboards generally used in a hot top, sideboards 14 and 17 are referred to as being in end-adjacent relationship with each other, and sideboards 15 and 16 are referred to as being next-adjacent (rather than being next end-adjacent) the two end-adjacent sideboards, to avoid confusion.

The device of this invention comprises a pair of oppositely disposed L-shaped members, also termed retainer clips, preferably made of heavy steel wire, indicated generally at 30 and 40, which are inserted within the surrounding inner liner of sideboards. Apex 31 of the L-shaped retainer clip 30 is placed in the corner formed by end-adjacent sideboards 14 and 17. Apex 41 of the L-shaped retainer clip is placed diagonally opposite apex 31, in the corner formed by next-adjacent sideboards 15 and 16. Arms 32 and 33, also referred to as L-arms, of the retainer clip 30 overlie the inner surfaces of the sideboards 14 and 17 respectively, and are pressed tightly thereagainst, as will be explained hereinafter, by virtue of the biasing action of the ends of the arms. In an analogous manner, arms 42 and 43, also referred to as L-arms, of the retainer clip 40 bias sideboards 15 and 16 against the sidewalls of the ingot mold coextensive with the sideboards.

Figure 2:
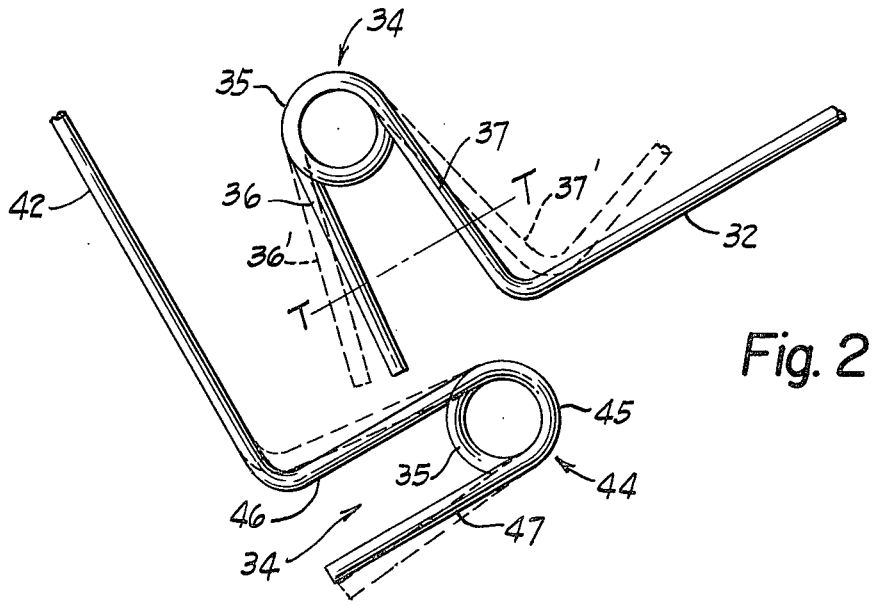
FIG. 2 is a perspective view of end portions of the arms of two retainer clips as placed in a corner of the hot top assembly, illustrated in transversely spaced apart relationship for clarity, and showing an unstressed end portions in phantom outline.

Referring now to FIG. 2 there is shown a perspective view in enlarged scale, of a corner of the hot top assembly where there is lodged one end portion of each of the arms 32 and 42, arm 32 being above arm 42. For clarity the ends are shown in laterally and vertically spaced apart relationship, though as lodged, one is directly above the other. Arm 32 has a generally U-shaped end portion indicated generally at 34, formed by bending a continuous piece of wire in such a way as to form a resilient loop 35 at the trough of the U-shaped end portion. I refer to the end portions as being U-shaped though they may be more V-shaped than U-shaped. As illustrated the resilient loop 35 is formed by bending the wire through about one and one-half turns, or about $3\pi/2$ radians or 540°. Thus the U-shaped end portion is formed with U-arms 36 and 37 approximately normal to the L-arm 32 of the L-shaped retainer, and in substantially the same plane therewith, U-arm 36 being vertically displaced from U-arm 37 by little more than the diameter of the wire. To get the desirable thrust from the U-shaped end portion it is necessary that, in the unstressed condition, the arms 36 and 37 diverge slightly from the loop 35, that is, give the end portion 34 a more noticeable V-shape as illustrated in the phantom outline of arms 36' and 37'. It will be recognized that the illustration in phantom outline is greatly exaggerated to emphasize the necessity of inculcating a spring action in the end-portion of each arm in such a way that, when a stressed end-portion is released, forces are generated which thrust parallel oppositely disposed sideboards away from each other, and press them against opposite sidewalls of the ingot mold. Thus the precise shape of the end portion is not critical as long as it is able to provide the desired spring action and thrust. Various modifications of the endportion of the arms will effect the desired results, as will be seen hereinafter.

In an analogous manner, retainer clip 40 carries near the end of its arm 42, an U-shaped end portion indicated generally at 44, formed by bending another continuous piece of wire into a resilient loop 45. A similar U-shaped end portion is also formed near the end of arm 43. As before, end portion 44 is formed with U-arms 46 and 47 approximately normal to the L-arm 42, and in substantially the same plane therewith.

To install the retainer clips, as shown in FIGS. 1 and 2, each U-shaped end portions may be compressed manually with a long-handled pliers, but it is more convenient to pretie the arms of each U-shaped end portion with wire tie-downs T—T as illustrated for arms 36–37, which compress the arms of each clip sufficiently to permit each retainer clip to be inserted within the four sideboards supported along the inner walls of the ingot mold. In the stressed position, the arms 36–37 of a U-shaped end portion are preferably essentially parallel, or otherwise sufficiently deformed from the unstressed U-shape, to enable the retainer clip to be positioned within the liner. The essentially parallel U-arms of each end portion, for example end-portion 34, provides an outer U-arm 36 which lies coextensively with the inner surface of the sideboard 14 and exerts pressure over a sufficient area of the sideboard so as not to poke through it. Installation of a retainer clip is completed by stressing the L-arms inwardly to position the clip in a horizontal position at a predetermined level within the hot top, and cutting the wire tie-downs T—T on each of the U-shaped end portions of a retainer clip. The compressive forces on the U-shaped members is thus released so that the arms of the U spring back, attempting to regain their original unstressed relationship with each other. The biasing force of this spring action of each of the U-shaped end portions results in each L-arm and each outer U-arm of an L-shaped retainer clip pressing simultaneously against each of the four sideboards. The L-arms, in particular, effect the desired tight disposition of at least two sideboards against the inner walls of the ingot mold, these two sideboards being coextensive with essentially the entire length of the L-arms of the L-shaped retainer clip.

The retainer clips 30 and 40 thus together provide a highly effective retainer for all four sideboards of the inner liner. It will be apparent that the retainer for plural sideboards will be equally effective with a continuous liner which is slip-fitted into an ingot mold. Similarly it will be apparent that the L-arms 32, 33 and 42, 43 will preferably be undulating if the sideboards have a corrugated inner surface, and the undulations in the arms should correspond to the corrugations, to provide a better thrusting force against the walls of the ingot mold.

Figure 3:
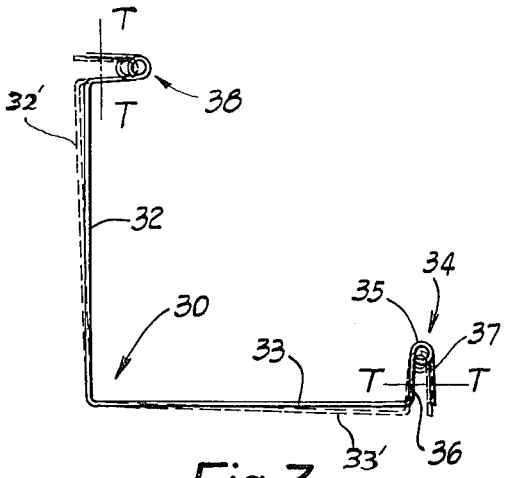
FIG. 3 is a plan view of an unstressed wire retainer clip shown in FIG. 1 in which clip a resilient loop is provided in the trough of each U-shaped portion formed at the end of each arm; the unstressed wire clip is shown in phantom view, with each arm deformed inwardly from near its end prior to insertion of the clip in the hot top assembly.

Referring now to FIG. 3 there is shown the L-shaped retainer clip 30 having L-arms 32 and 33 with generally U-shaped end portions 34 and 38 with tie-downs T—T holding the end portions in a stressed position. Unstressed U-shaped end-portions are shown in phantom outline, as are the unstressed L-arms 32' and 33', which are inclined with respect to each other at an obtuse included angle. That is, unstressed arms 32' and 33' are at slightly greater than 90° before they are positioned within the sideboards. Assuming end-adjacent walls of the ingot mold are essentially perpendicular or normal, the positioned retainer clip assumes a position with L-arms 32 and 33 in a stressed orthogonal or normal position, as shown in solid outline. As in FIG. 3 subsequent illustrations of other embodiments of my retainer clip, are shown in a stressed position, as if each was positioned in a typical ingot mold.

Figure 4:
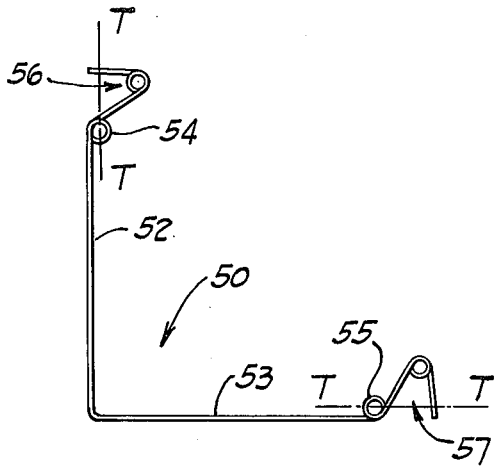
FIG. 4 is a plan view of another embodiment of a retainer clip wherein two resilient loops are provided near the end of each arm which terminates in a V-shaped spring end portion.
Figure 5:
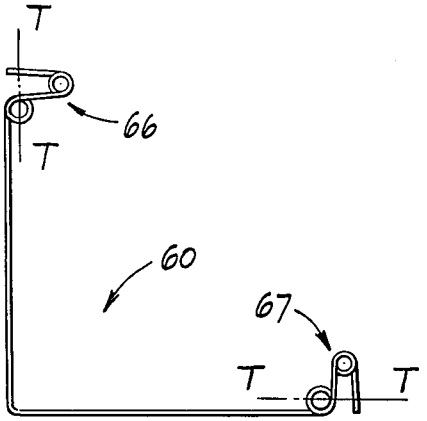
FIG. 5 is a plan view of another embodiment of a retainer clip wherein two resilient loops are provided near the end of each of arm, one loop at the beginning of the U-shaped end portion, and the second loop at the trough of the U-shaped end portion.

Referring now to FIG. 4, there is shown an L-shaped retainer clip indicated generally by the reference numeral 50, wherein the arms 52 and 53 of the clip are provided with additional resilient loops 54 and 55 prior to the formation of the U-shaped end portions 56 and 57. As will be seen from the illustration in FIG. 4, the end portions may be more V-shaped than U-shaped. Another embodiment is illustrated in FIG. 5 wherein a retainer clip indicated generally by the reference numeral 60 utilizes more clearly U-shaped end portions 66 and 67 for more uniformly distributed thrust against next-adjacent sideboards.

Figure 6:
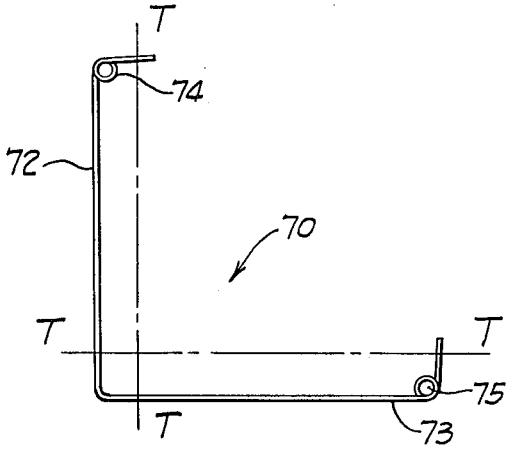
FIG. 6 is a plan view of still another embodiment of the retainer clip schematically illustrating a resilient loop formed near the end of each arm.

Another embodiment of an L-shaped retainer clip is illustrated in FIG. 6 and identified generally by the reference numeral 70. Arms 72, 73 are each provided with resilient loops 74 and 75 near their ends, by bending the wire through about one and one-quarter turns, or about $5\pi/4$ radians or about 450°.

Figure 7:
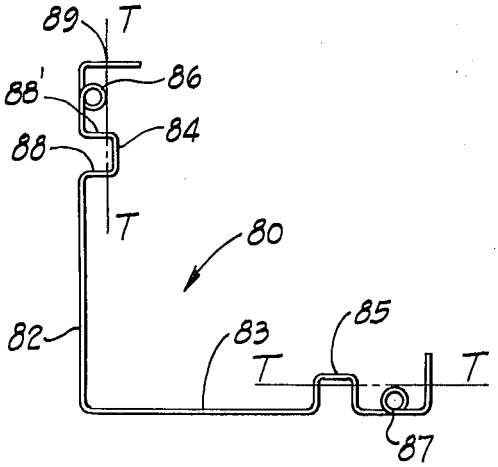
FIG. 7 is a plan view schematically illustrating a retainer clip wherein each arm is bent in a U-shaped compression loop essentially in the same plane as the arms of the L-shaped member, the U-shaped compression loop being intermediate the apex and a spring end of each arm.

Additional spring action may be imparted to the retainer clip of FIG. 6 as modified in the embodiment illustrated in FIG. 7 and identified by reference numeral 80. Compression loops 84 and 85 are provided in each arm by bending each arm in a U-shape in substantially the same plane as the arms 82 and 83. The spring action of compression loops 84 and 85 serves to augment the spring action of resilient loops 86 and 87 formed near the ends of each of the L-arms 82 and 83. Each resilient loop is formed by bending the wire of each arm through a single turn. Moreover either laterally projecting portion 88 or 88' of the compression loop 84 affords a convenient location for drawing in the stub end 89 of the U-shaped end portion of the arm 82 by a tie-down T—T. It will be noted that the U-shaped end portion of the arm 82 and the compression loop 84 share a common laterally projecting portion 88', but it will be evident that this is not necessarily so since the compression loop may be spaced apart from the U-shaped end portion without sharing a common lateral projection.

Figure 8:
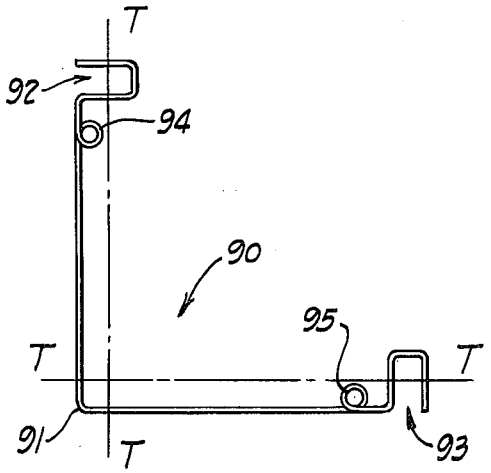
FIG. 8 is a plan view of yet another embodiment of the retainer clip schematically illustrating a U-shaped spring end including a resilient loop adjacent the U-shaped compression loop near the end.

Still another embodiment of an L-shaped retainer clip having L-arms which carry U-shaped end portions is illustrated in FIG. 8 wherein a retainer clip 90 has U-shaped spring ends 92 and 93 formed more distally from the apex 91 than the resilient loops 94 and 95. Each resilient loop is formed by bending each arm through a single turn, as before. The resilient loops and the spring end portions are in substantially the same plane. Compression of the U-shaped end portion is affected by tie-downs T—T as shown in the drawing.

Figure 9:
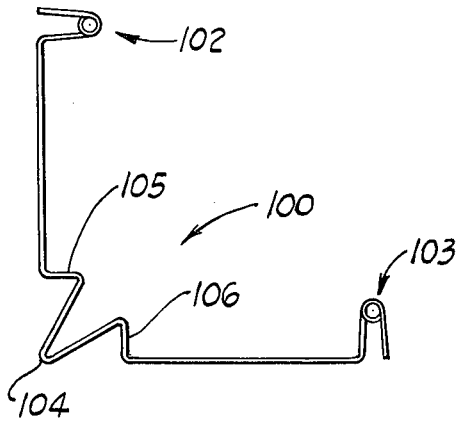
FIG. 9 is a plan view of an embodiment of the retainer clip schematically illustrating a V-shaped apex for enhanced flexibility of the arms.

It is not critical that the L-shaped retainer clip of my invention have a substantially rectangular apex, provided that the L-arms diverge from near the apex approximately normal to each other. Enhanced flexibility and divergent biasing strength of the L-arms may be obtained by utilizing a spring-apex, formed as described hereinafter. In the embodiment shown in FIG. 9 there is shown a retainer clip, indicated generally by the numeral 100 having U-shaped end portions 102 and 103 formed as described in FIG. 3, inter alia, and a V-shaped apex 104, referred to as a spring-apex, having short bent laterally projecting segments 105 and 106 which permit greater effectiveness of the spring-apex than that derived from the rectangular apex illustrated in FIGS. 3–8. The retainer clip 100 lies in substantially the same plane, as do all embodiments of my retainer clip.

Figure 10:
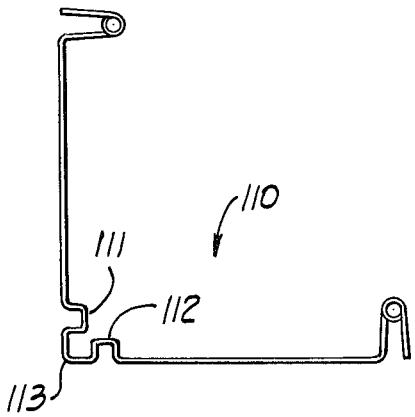
FIG. 10 is a plan view of another embodiment of a retainer clip schematically illustrating another modification of the apex of the L-shaped member for enhanced flexibility of the arms.
Figure 11:
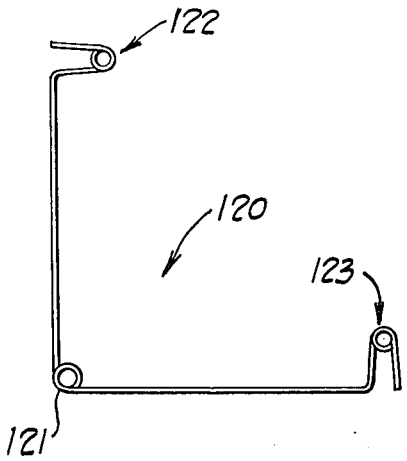
FIG. 11 is a plan view of another embodiment of the retainer clip schematically illustrating a resilient loop formed at the apex of the L-shaped member.

Still other embodiments of apexes provided with additional spring force are illustrated in FIGS. 10 and 11. In FIG. 10 the retainer clip 110 is provided with U-shaped compression loops 111 and 112 near the apex 113. In FIG. 11 the retainer clip 120 is provided with a resilient spring loop 121 at the apex, and U-shaped end portions 122 and 123, formed as described hereinabove. The spring loop 121 is formed by bending the wire at the apex through one and one-fourth turns or $3\pi/2$ radians.

Figure 12:
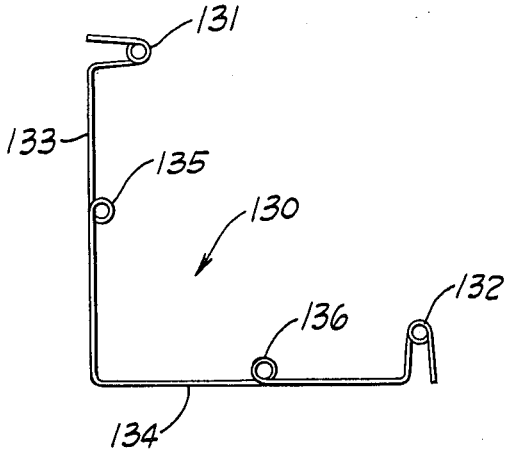
FIG. 12 is a plan view of another embodiment of the retainer clip schematically illustrating a resilient loop formed in each arm of the L-shaped member intermediate the apex and the resilient loop in the U-shaped end portion.

In large ingot molds, particularly where the sides are not rectangular, it may be difficult to insert a retainer clip and release it in such a way that the arms lie substantially along the inner surface of the sideboards. This is because the U-shaped end portions or spring ends of the retainer clips exert a force against oppositely disposed parallel sideboards which force may tend to bow the arms inwardly. To combat this problem there is shown in FIG. 12 a retainer clip 130 such as may be particularly useful in large ingot molds, which is provided with U-shaped end portions 131 and 132 as described hereinbefore. Each arm 133 and 134 is provided intermediate its length, with resilient spring loops 135 and 136 formed by bending each arm through one complete turn. Additional resilient spring loops (not shown) may be provided, if so desired, in each arm.

It will be evident to those skilled in the art that some of the embodiments disclosed hereinabove may be more preferred than others, either because of cost, the tolerances which must be accomodated from one hot top to another, the physical characteristics of the wire or rod used, and other reasons. Additional modifications may be made to tailor a retainer clip for a particular hot top, but an effective retainer for a hot top will utilize two retainer clips with U-shaped end portions, and the apex of one retainer clip will be diagonally oppositely disposed from the apex of the other without there being any necessary connection between the two retainer clips. Clearly, more than two retainer clips may be used, but there is no economic justification for doing so with conventional hot tops. It will also be evident to one skilled in the art that the thickness of wire used will depend on the physical properties of the wire. Spring steel permits the use of thinner wire, but is more expensive than bright basic. Generally steel wire from about 3/16 in. in diameter to about 5/16 in diameter suffices for most hot tops. Spring steel wire ⅛ in. in diameter may be used for relatively small hot tops and ¼ in. spring steel wire may be used for relatively large hot tops.

I claim:

1. A device for securing a hot top for an ingot mold having an open top and inner walls of generally rectangular outline against which an inner liner of plural sideboards is supported near said open top, comprising a pair of diagonally oppositely disposed L-shaped continuous wire retainer clips for biasing said inner liner into closefitting engagement with said inner walls, each of said clips having at least one resilient loop near the end of each of two arms, each of said arms extending snugly along substantially the entire length of each of two sideboards in end-adjacent relationship with each other and, the end portion of each arm beyond said loop biasing against one of the next adjacent sideboards.

2. The device of claim 1 wherein said resilient loop comprises a rod or wire bent through at least one complete turn.

3. A wire retainer clip for a hot top assembly to bias sideboards against the inner walls of an ingot mold, said clip comprising an L-shaped continuous rod or wire having a pair of arms, one arm substantially perpendicular to the other arm, each arm disposed in abutting relationship against each of two end-adjacent generally orthodonal sideboards to bias said each of two sideboards snugly against an inner wall of said ingot mold co-extensive with said each sideboard, each said arm carrying near its end, a resilient loop of said wire bent through at least one complete turn, said loop lying in substantially the same plane as said arms and terminating in a linear end portion which pressingly abuts a sideboard next adjacent said each of two end-adjacent sideboards.

4. The wire retainer clip of claim 3 including in addition a compression loop formed in each arm.

5. The wire retainer clip of claim 3 including in addition at least one additional resilient loop formed in each arm.

* * * * *